US006944976B2

(12) United States Patent
Sapp

(10) Patent No.: US 6,944,976 B2
(45) Date of Patent: Sep. 20, 2005

(54) PROTECTIVE AND/OR DECORATIVE SHOE COVER

(76) Inventor: Charles W. Sapp, P.O. Box 37001, Houston, TX (US) 77237

( * ) Notice: Subject to any disclaimer, the term of this patent is extended or adjusted under 35 U.S.C. 154(b) by 0 days.

(21) Appl. No.: 10/682,048

(22) Filed: Oct. 9, 2003

(65) Prior Publication Data

US 2005/0076538 A1 Apr. 14, 2005

(51) Int. Cl.[7] ..... A43B 13/22
(52) U.S. Cl. ..... 36/72 R; 36/7.1 R; 36/100
(58) Field of Search ..... 36/7.1 R, 7.2, 36/7.5, 72 R, 77 R, 100, 101, 136, 132, 133

(56) References Cited

U.S. PATENT DOCUMENTS

| | | | | |
|---|---|---|---|---|
| 1,053,024 | A | * 2/1913 | Fritzsche | 36/72 R |
| 1,160,162 | A | * 11/1915 | Haas | 36/73 |
| 1,382,748 | A | * 6/1921 | Slasor | 36/72 R |
| 1,663,381 | A | * 3/1928 | McKinley | 36/7.2 |
| 2,984,917 | A | * 5/1961 | Saunders | 280/811 |
| 3,040,451 | A | * 6/1962 | Hilkemeyer | 36/7.5 |
| 3,667,140 | A | 6/1972 | Hunderford | |
| 4,005,534 | A | 2/1977 | Crist et al. | |
| 4,083,124 | A | 4/1978 | Michalak | |
| 4,333,248 | A | 6/1982 | Samuels | |
| D286,460 | S | 11/1986 | Haber | |
| 4,862,606 | A | 9/1989 | Siskind et al. | |
| 4,896,439 | A | * 1/1990 | Morgan | 36/7.5 |
| 5,272,822 | A | 12/1993 | Diaz | |
| 5,367,794 | A | 11/1994 | Adelstein et al. | |
| 5,544,430 | A | 8/1996 | Jacko | |
| 5,566,476 | A | * 10/1996 | Bertrand et al. | 36/72 R |
| 5,701,688 | A | 12/1997 | Crowley | |
| 5,711,092 | A | 1/1998 | Despres et al. | |
| 5,765,297 | A | 6/1998 | Cooper et al. | |
| 5,822,887 | A | 10/1998 | Turner | |
| 5,845,416 | A | 12/1998 | Hands | |
| 5,873,185 | A | 2/1999 | Harris et al. | |
| 5,898,939 | A | 5/1999 | Schramm | |
| 5,907,881 | A | 6/1999 | Safdie | |
| 5,926,978 | A | 7/1999 | Smith | |
| 5,987,778 | A | 11/1999 | Stoner | |
| 5,996,258 | A | 12/1999 | Simmons | |
| 6,038,792 | A | 3/2000 | Hauter | |
| D425,289 | S | 5/2000 | Sheppard, Jr. et al. | |
| 6,408,542 | B1 | 6/2002 | Shepherd | |
| 6,421,936 | B1 | 7/2002 | Gerrand | |
| 6,449,878 | B1 | 9/2002 | Lyden | |
| 6,470,600 | B1 | 10/2002 | Louie | |
| 6,499,233 | B1 | 12/2002 | Chenevert | |
| 6,505,424 | B2 | * 1/2003 | Oorei et al. | 36/129 |
| 6,560,781 | B1 | 5/2003 | Keene et al. | |
| 2002/0124436 | A1 | 9/2002 | Hatfield et al. | |
| 2002/0133979 | A1 | 9/2002 | Gantier | |
| 2003/0088996 | A1 | 5/2003 | Hall | |

FOREIGN PATENT DOCUMENTS

| | | | |
|---|---|---|---|
| FR | 2634630 | * | 2/1990 |
| GB | 2198923 | * | 6/1988 |
| WO | WO 94/09666 | | 5/1994 |
| WO | WO 96/22711 | | 8/1996 |

* cited by examiner

*Primary Examiner*—M. D. Patterson

(57) ABSTRACT

Disclosed herein is a shoe cover preferably useable with a cleated shoe to protect an athlete's foot. The shoe cover is preferably formed of a flexible plastic material and is generally "U" shaped to fit around the top and side portions of a shoe. The shoe cover preferably contains slits which appear on the side of the shoe cover. Straps are woven through these slits and between the cleats on the bottom of the shoe to provide loops for lacing the shoe cover to the shoe.

11 Claims, 4 Drawing Sheets

PROTECTIVE AND/OR DECORATIVE SHOE COVER

FIELD OF THE INVENTION

This invention relates generally to a shoe cover placeable over a shoe to protect the top of an athlete's foot, and/or to merely to decorate a shoe.

BACKGROUND

Many sports, such as football, soccer, or baseball, are played by athletes who wear cleated shoes. As is known, cleats on the bottom of the shoe allow athletes to gain better traction on grass or artificial turfs.

In close contact sports like football, athletes occasionally step on one another's feet. This is a painful experience for the athlete, particularly when a cleated shoe steps on his foot. The result is often a painful bruise on the top of the athlete's foot, which is at least a nuisance even if it does not seriously injure the athlete or require the athlete to stop playing.

Many examples can be found in the prior art of devices that cover shoes for the purpose of protecting the wearers' feet and/or the shoes themselves. However, such prior art shoe covers are not optimal for any number of reasons. Some require the addition of structures to the shoe itself to affix the shoe cover to the shoe, which is impractical as such approaches cannot be used with normal everyday shoes without modification. Other shoe covers in the prior art are not expected to be suitably durable for use in high impact sport, such as football, as their construction is rather weak, running the risk that the shoe cover will be torn from the shoe. Still other shoe cover approaches are simply too costly, rivaling the cost of the shoe itself, which is also not practical.

Moreover, some of these prior art shoe covers are simply not pleasing to the eye. In this regard, it should be noted that the decor of an athlete can be important. An athlete does not want to wear something on his shoe that does not look interesting, that looks clumsy, or that clashes with the rest of the athlete's uniform.

The disclosed shoe cover solves these respective problems of the prior art by providing a shoe cover preferably useable with a cleated shoe that is effective at protecting the foot, does not require modification to the shoe to which it will be attached, is sturdy in construction, is cheap and easy to manufacture, is easy to put on the shoe, and which is, for lack of better words, "cool looking."

SUMMARY OF THE INVENTION

Disclosed herein is a shoe cover preferably useable with a cleated shoe to protect an athlete's foot. The shoe cover is preferably formed of a flexible plastic material and is generally "U" shaped to fit around the top and side portions of a shoe. The shoe cover preferably contains slits which appear on the side of the shoe cover. Straps are woven through these slits and between the cleats on the bottom of the shoe to provide loops for lacing the shoe cover to the shoe.

BRIEF DESCRIPTION OF THE DRAWINGS

The foregoing summary, preferred embodiments, and other aspects of the inventive concepts will be best understood with reference to a detailed description of specific embodiments, which follows, when read in conjunction with the accompanying drawings, in which.

DETAILED DESCRIPTION

Figure 1:
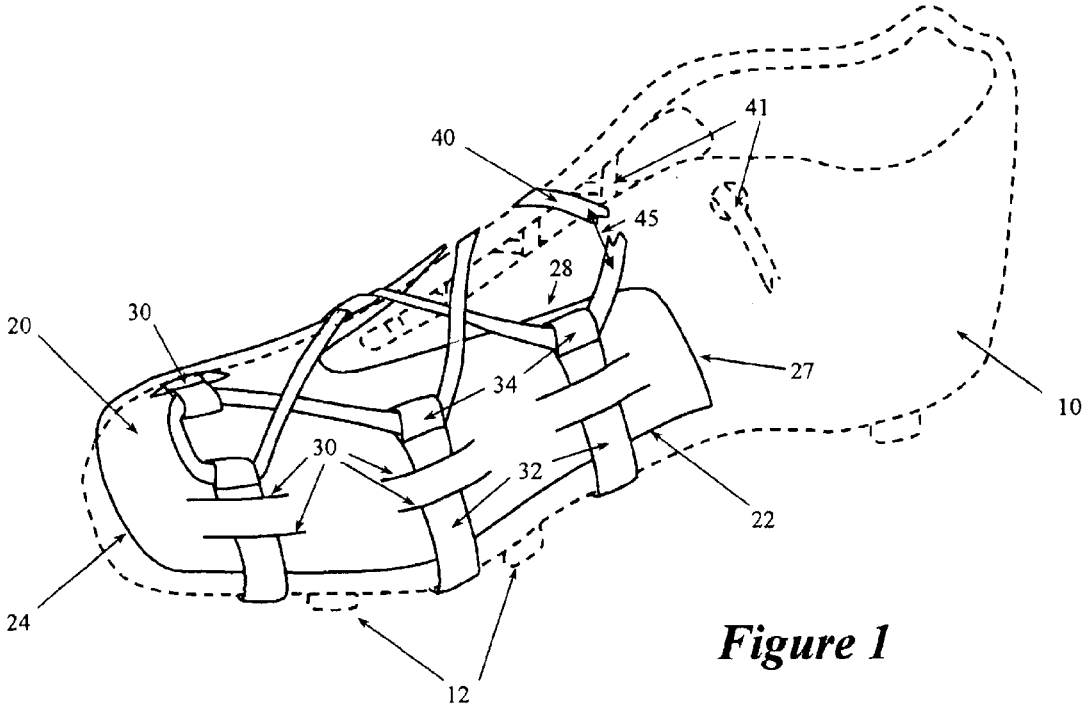
FIG. 1 shows a perspective view of the disclosed shoe cover positioned on a cleated shoe.
Figure 3:
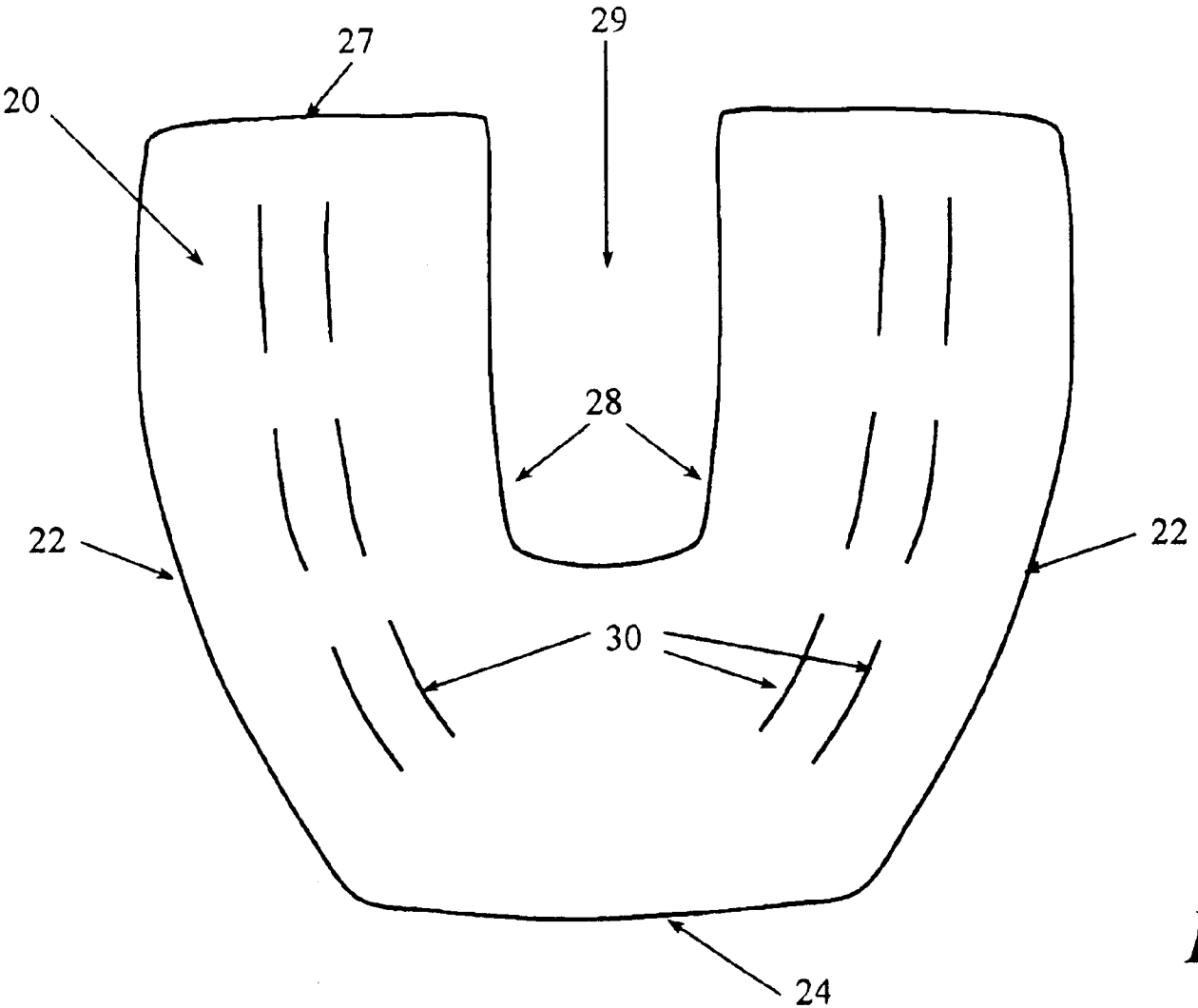
FIG. 3 shows a top view of the shoe cover in isolation.

FIG. 1 shows a perspective view of the disclosed shoe cover 20, preferably useable with a shoe 10 having cleats 12. As shown in FIG. 1, the shoe cover 20 basically fits over the top and sides of the shoe 10, where an athlete's foot is most likely to be stepped on. More specifically, the shoe cover 20, shown in isolation in a top view in FIG. 3, is basically "U" shaped. When positioned over the shoe, the side edges 22 of the shoe cover 20 extend towards the side edges of the shoe. The front edge 24 of the shoe cover 20 similarly extends near to the toe of the shoe. The back edges 27 of the shoe cover extend near to the wearer's ankle.

Figure 4B:
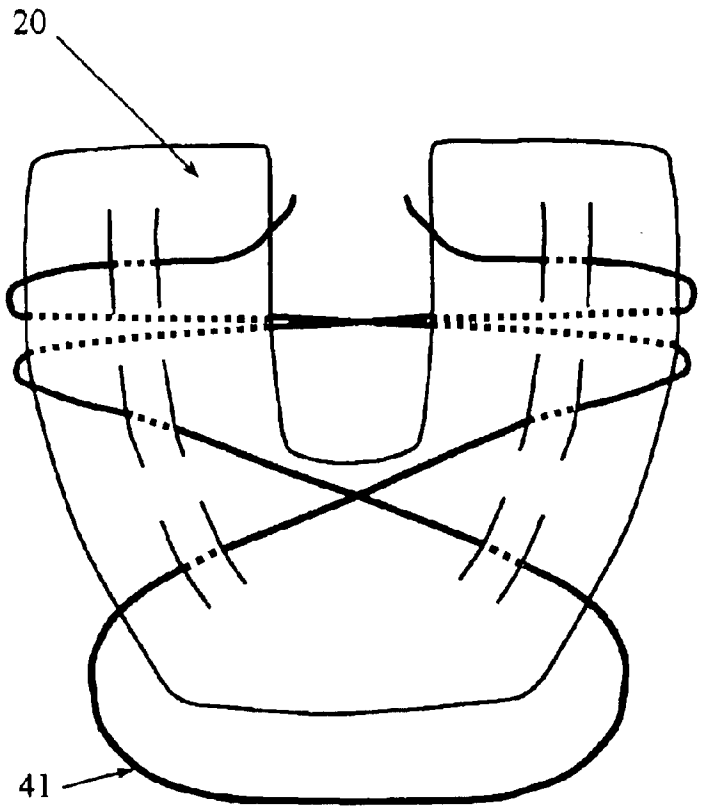
FIG. 4B shows diagrammatically how shoe cover can be laced without straps and using a standard shoe lace.
Figure 4A:
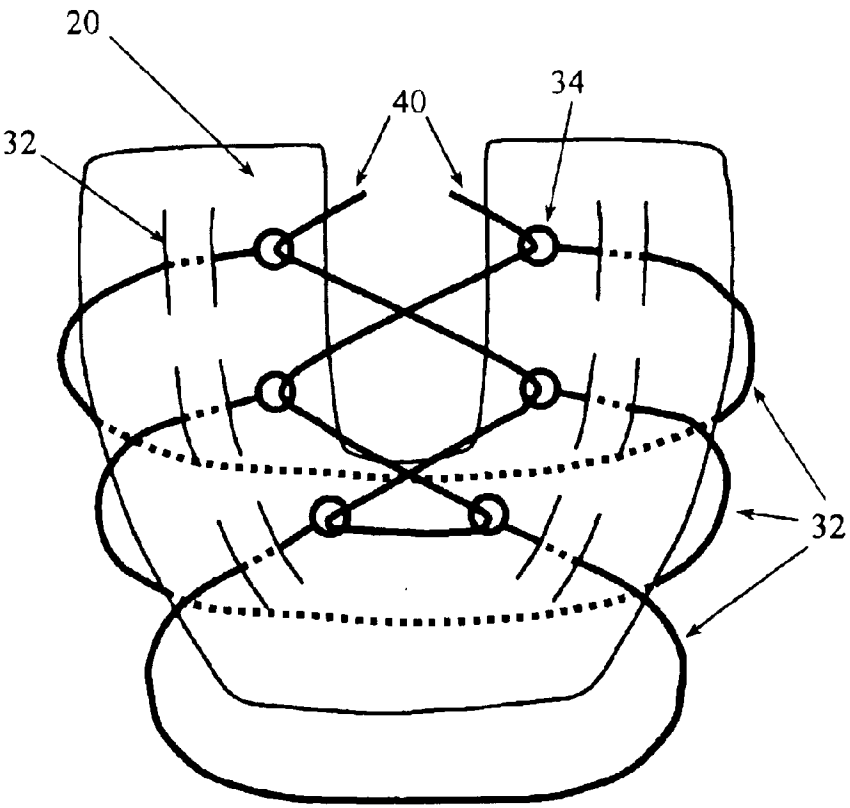
FIG. 4A shows diagrammatically how the shoe cover is laced using the straps and a shoe cover lace.

As shown, the shoe cover 20 is laced with a shoe cover lace 40, in much the same way the shoe 10 is usually laced with a normal show lace 41. As shown, the shoe cover contains slits 30 formed therein to allow straps 32 to be weaved therethrough and around the underside of the shoe. Three straps 32 and their associated slits 30 are shown on the left and right side of the shoe cover, although two or more straps 32 could also be used. Each strap 32 is preferably formed of a durable nylon webbing, and at both its ends it is preferably sown onto itself to form loops 34. Once the straps are positioned into place through the slits 30, the loops 34 are formed in series at the inner edge 28 of the shoe cover, through which the shoe cover lace 40 is laced and tied (see arrow 45) in a conventional fashion. A diagrammatical view showing the assembled orientation of the slits 30, straps 32, loop 34, and shoe cover lace 40 is shown in FIG. 4A.

Figure 2:
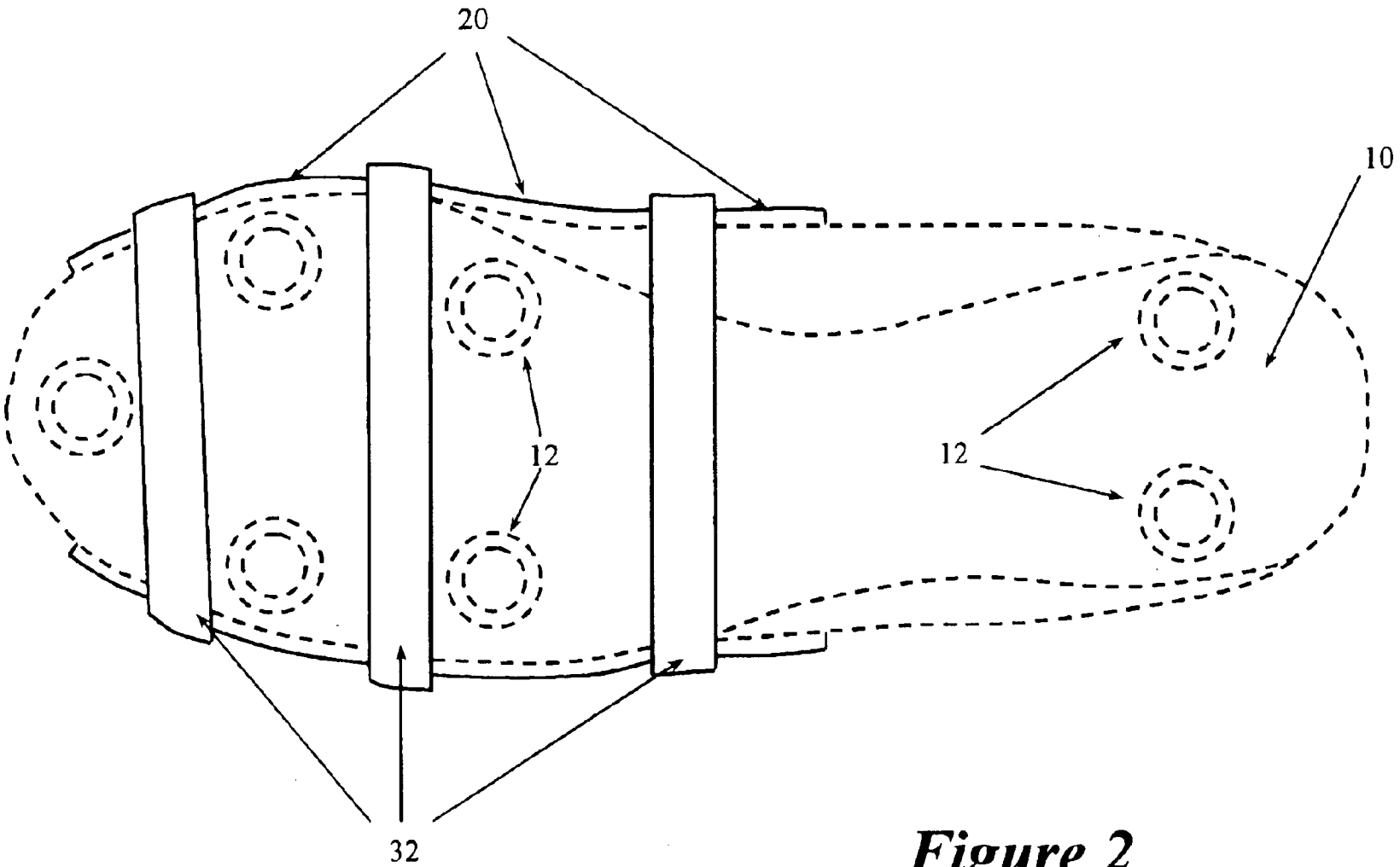
FIG. 2 shows the underside of the shoe, and shows how the shoe cover is fastened thereto using straps running between the cleats.

Once the straps 32 and shoe cover lace 40 are woven into place on the shoe cover 20, the shoe cover 20 can be slipped over the front part of the shoe 10, and the shoe cover lace 40 drawn tight to firmly hold the shoe cover 20 in position over the shoe 10. As shown in the bottom view of FIG. 2, the straps 32 are preferably placed between the cleats 12 on the bottom of the shoe 10, which helps to keep the shoe cover 20 from sliding off the shoe 10 once it is firmly tied into place. Attaching the shoe cover 20 in this fashion is preferably performed while the shoe 10 is on the athlete's foot, but it can also be performed before the shoe 10 is put on the athlete's foot. Because of the opening 29 in the shoe cover (see FIG. 3), the shoe laces 41 for the shoe 10 are accessible through the shoe cover 20 even when in position on the shoe 10.

The shoe cover 20 can be formed of any of several materials. In one embodiment, the shoe cover is made of a flexible plastic, such as Glas-Flex35 manufactured by Simona AG, Techiweg 16, D-55606 Kim (Germany). Such a flexible plastic is preferably uniform in thickness, ranging between 1/16 to 3/16 inch thick. Use of a flexible material is preferred because the shoe cover 20 will conform to the shoe 10 (and to the athlete's foot) when firmly tied to the shoe 10 using shoe cover laces 40. In this regard, it should be noted that the shoe cover 20 could be manufactured and sold as a "one size fits all" item, as a single cover 20 size could be expected to adequately cover, for example, all reasonable adult male shoes; smaller shoes would simply have the cover 20 fit closer to the bottom of the shoe, while larger shoes would simply have the cover 20 ride up higher on the shoe. In either circumstance, adequate protection for the top and sides of the foot is provided. In any event, the edges of the flexible material of the shoe cover 20 could be trimmed with a razor if necessary to accommodate a particular shoe size.

Alternatively, the shoe cover 20 could be made of other flexible materials (such as thick nylon webbing, similar to the laces 40, or burlap), or could be made of a hard material, such as a hard plastic like polyvinyl chloride (PVC) or Teflon. The material at issue can be transparent or opaque, and can be suitably colored to match the uniforms of a particular team. Glitter can be added to the material if desired to achieve a certain look. Additionally, the underside of the cover 20 that comes in contact with the shoe can be padded to provide extra protection and cushion to even further protect the athlete's foot.

Regardless of the material used, the shoe cover 20 will provide at least some measure of protection to the athlete's foot from getting stepped on by another cleated shoe. Moreover, the shoe cover 20 is easy to put on the shoe 10, and requires no special modifications to the shoe 10. It also allows, through opening 29, access to the laces 41 of the shoe 10 such that the shoe 10 can be tied or re-tied without the need to remove the shoe cover 20.

When formed of Glas-Flex35, the shoe cover 20 can be easily and cheaply manufactured. As the disclosed shoe cover 20 constitutes one uniform (i.e., singular) piece of material, the shoe covers 20 can be pressed out from a flat sheet of Glas-Flex35, and during this pressing procedure the slits 30 can be perforated at the same time. The straps 32 and laces 40 can either be sold separately with the cover 20, with instructions to the user as to how to affix the straps 32 and the laces 40. Alternatively, the straps 32 and laces 40 can be affixed and laced to the shoe cover 20 by the manufacturer and sold that way.

If a hard material such as a hard plastic is used, the shoe cover 20 is preferably molded to generally shape the cover 20 in conformance with the shoe 10 to which it will be affixed. Even when made of hard plastic, the act of tying the shoe cover 20 to the shoe 10 can still cause the cover 20 to conform to the athlete's foot so long as the material is not too hard.

It should be noted that it is not strictly necessary to use separate straps 32 and laces 40 with the disclosed shoe cover 20. For example, standard shoe laces 41 (assuming they are long enough) can themselves be woven through the slits 30 and underneath the shoe 10, to in effect serve the purposes of both the straps 32 and the laces 40, such as is shown diagrammatically in FIG. 4B.

Other modifications to the disclosed shoe cover are possible. For example, the slits 30 are shown in pairs, such that on end of a strap 32 (or normal lace 41) can be woven in and out of the shoe cover on one side. This is desired for stability. However, such a paired slit configuration one each side in not necessary. Instead, only a single slit can be used.

Although thought particularly useful for sports using cleated shoes, the disclosed shoe cover could be used to protect a wearer's feet in other circumstances, e.g., such as a construction site.

It is preferred that the shoe cover be used with cleated shoes, but this is not strictly necessary. The shoe cover could be worn with regular shoes as well, although in this instance care should be taken to ensure that the straps 32 appearing on the bottom of the shoe 10 (see FIG. 2) are suitably resilient for the environment in question (e.g., asphalt). In this regard, the straps 32 may also be made of a suitable wear resistant rubber or plastic material, or may be rubber or plastic coated.

It should be understood that the inventive concepts disclosed herein are capable of many modifications. To the extent such modifications fall within the scope of the appended claims and their equivalents, they are intended to be covered by this patent.

What is claimed is:

1. A shoe cover for protecting a shoe, comprising:

a uniform singular flat material of uniform thickness placeable over top and side portions of a shoe, the uniform material having a left and right side;

a plurality of slits on both the left and right sides of the uniform material;

a plurality of straps each having loops on its ends, wherein the ends of each strap are respectively positioned through at least one slit on the left and at least one slit of the right side of the uniform material; and a lace woven through the loops for affixing the shoe cover to the top and side portions of the shoe.

2. The shoe cover of claim 1, wherein the material comprises plastic.

3. The shoe cover of claim 1, wherein the slits appear in pairs on both the left and right sides, and wherein the ends of the straps are woven in and out of each pair on each side.

4. The shoe cover of claim 1, wherein the material is U-shaped to fit over the top and side portions of the shoe.

5. The shoe cover of claim 1, wherein the material is flexible.

6. An improved shoe system, comprising:

a shoe; and a shoe cover positioned over top and side portions of the shoe, the shoe cover comprising:

a uniform singular flat material of uniform thickness having a left and right side;

a plurality of slits on both the left and right sides of the uniform material;

a plurality of straps each having loops on its ends, wherein the ends of each strap are respectively positioned through at least one slit on the left and the right side of the uniform material and around an underside of the shoe; and a lace woven through the loops for affixing the shoe cover to the top and side portions of the shoe.

7. The system of claim 6, wherein the material comprises plastic.

8. The system of claim 6, wherein the slits appear in pairs on both the left and right side, and wherein the ends of the straps are woven in and out of each pair on each side.

9. The system of claim 6, wherein the shoe comprises cleats on the underside of the shoe, and wherein the lace is woven between the cleats on the underside of the shoe.

10. The system of claim 6, wherein the material is U-shaped to fit over the top and side portions of the shoe.

11. The system of claim 6, wherein the material is flexible.

* * * * *